United States Patent [19]

Lautenschlager

[11] Patent Number: 4,639,145

[45] Date of Patent: Jan. 27, 1987

[54] DRAWER GUIDE

[75] Inventor: Horst Lautenschlager, Reinheim, Fed. Rep. of Germany

[73] Assignee: Karl Lautenschläger GmbH & Co. KG, Reinheim, Fed. Rep. of Germany

[21] Appl. No.: 873,715

[22] Filed: Jun. 12, 1986

[30] Foreign Application Priority Data

Jun. 19, 1985 [DE] Fed. Rep. of Germany ..... 3521860

[51] Int. Cl.[4] ..... F16C 19/00; A47B 88/00

[52] U.S. Cl. ..... 384/19; 312/341 R; 384/55

[58] Field of Search ..... 384/18–22, 384/50, 54, 55, 58; 312/341 R, 339, 340; 238/148, 122

[56] References Cited

U.S. PATENT DOCUMENTS

| | | | |
|---|---|---|---|
| 2,873,150 | 2/1959 | Hutzelman | 384/19 |
| 3,464,744 | 9/1969 | Fall | 384/19 |
| 4,549,774 | 10/1985 | Bessinger | 384/19 |

FOREIGN PATENT DOCUMENTS

| | | | |
|---|---|---|---|
| 3432245 | 3/1985 | Fed. Rep. of Germany | 312/330 R |

*Primary Examiner*—Stuart S. Levy
*Assistant Examiner*—Thomas R. Hannon

[57] ABSTRACT

On a drawer guide having a guide track to be fastened to the carcase of a cabinet and a runner track to be fastened to a drawer side, the drawer or other sliding device is movable relative to the cabinet by at least one wheel journaled at the front end of the guide track and at least one wheel journaled at the rearward end of the runner rail, each wheel rolling against a flange on the opposite rail. A circumferential groove is provided on each of the rolling surfaces of the wheels, and in it there is inserted a resilient tire of rubber, plastic or other elastomeric material, which then protrudes above the rolling surface of the wheel. In the end portions of the tracks, at the points where the wheels are at rest when the drawer guide is fully retracted, an indentation or groove of short length is provided in alignment with the resilient tire, and the depth thereof is at least equal to the height of the resilient tire above the rolling surface of the wheel.

2 Claims, 1 Drawing Figure

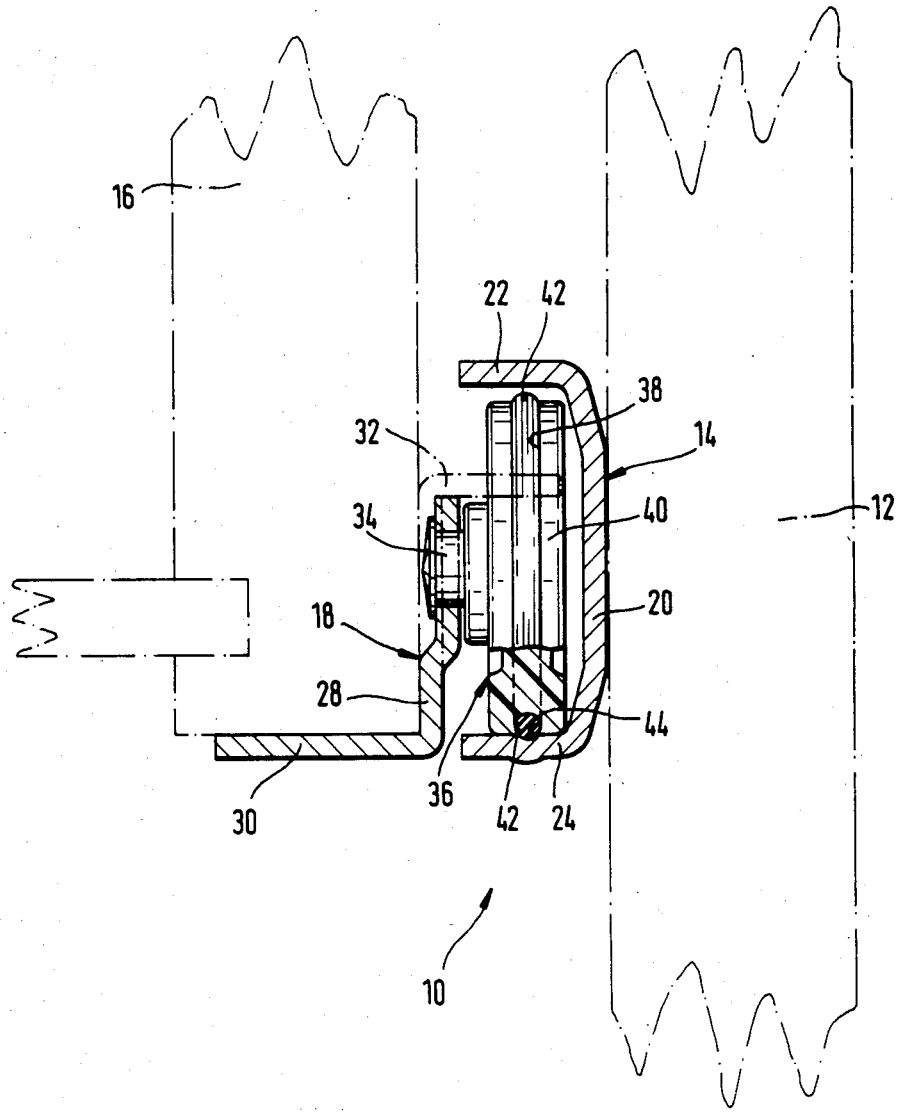
16
22
42
38
32
14
34
40
12
18
20
28
44
30
36
42
24
10

DRAWER GUIDE

BACKGROUND OF THE INVENTION

The invention relates to a guide for drawers and other such furniture parts, having a guide track which can be fastened to the wall of a cabinet carcase and a corresponding runner track which can be fastened to the drawer or other such furniture part, the tracks being displaceable relative to one another by means of wheels rotatably mounted, one on the front end of the guide track and rolling on the flange of the runner track and another on the back end of the runner track and rolling on the flange on the guide track, at least one circumferential groove being provided in the rolling surfaces of the wheels, in which a resilient tire of rubber, plastic or other elastomeric material is inserted and protrudes slightly above the rolling surface.

In such drawer guides (DE-GM 71 29 122) the tires inserted into the circumferential grooves serve to muffle the rolling noise of the wheels on the tracks when the drawers mounted in a cabinet carcase with such drawer guides are moved out or in.

Now, it has been found that, when constantly deformed at the same point, the material of the elastomeric tires become permanently deformed by a certain, though slight, amount. Particularly the section of the tire protruding above the rolling surface and resting on the corresponding track flange when the drawer is in the closed state undergoes in the course of time a slight permanent flattening, and as a result the drawer no longer can be opened or closed gently and smoothly with little effort, but is noisy and bumpy in operation.

Consequently, it is the object of the invention to create a quietly running drawer guide in which the action of its mechanism will not deteriorate as a result of permanent deformation of its tires.

SUMMARY OF THE INVENTION

Setting out from a drawer guide of the kind mentioned above, this object is achieved according to the invention by the fact that, in the end sections of the track flange which are supported on the rolling surfaces of the wheels when the tracks are in the fully closed position, a narrow indentation or recess is provided, which is in alignment with the resilient tire and which extends a short distance in the opening direction of the drawer, and whose depth is at least equal to the radial elevation of the resilient tire above the rolling surface of the wheel. This brings about that, in the fully closed state, it is not the tire but the non-deforming running surfaces of the wheels on each side of it that are supported on the associated track, while the tire is relieved of the load and accordingly cannot be permanently deformed.

As a rule, the relieving of the load on the tire in the fully closed state of the drawer will suffice, but especially in the case of drawer guides which are left open for a relatively long time, such as drawer guides for filing cabinets or the like, it may be desirable to provide in the end portions of the track which rest on the wheels when the tracks are in the fully open state, an additional narrow indentation or recess extending a short distance in the drawer opening direction, in alignment with the resilient tire, and having a depth at least equal to the radial elevation of the resilient tire above the rolling surface of its wheel.

BRIEF DESCRIPTION OF THE DRAWING

The invention will be further explained in the following description of an embodiment in conjunction with the drawing which shows a cross section taken through the cabinet-interior end of a single drawer guide in the area of the wheel at that point, in a plane at right angles to the drawer opening direction.

DETAILED DESECRIPTION OF PREFERRED EMBODIMENT

The drawer guide according to the invention, shown in the drawing and designated as a whole by the number 10, is composed of the guide track 14 which can be fastened on the carcase wall 12, indicated in broken lines in the drawing, and the runner track 18 which can be fastened to the drawer side 16, also indicated in broken lines. Both tracks are stamped from sheet metal. The guide track 14 has a channelshaped cross section with two flanges 22 and 24 bent outwardly at right angles from a web 20 which can be screwed to the wall 12. The runner track 18 which can be screwed to the drawer side 16 likewise has two flanges bent at right angles from a vertical web 28, but only the lower flange 30 reaching under the drawer side 16 is visible, while the position of the upper flange 32, which is bent in the opposite direction, i.e., toward the wall 12, is indicated only in broken lines, because it is cut away in the rearward area that is illustrated, for the purpose of providing room for the wheel 36 journaled on a pivot pin 34 riveted into the web 28. The wheel 36 has, in a circumferential groove 38 in its outer rolling surface 40 the above-mentioned resiliently deformable tire 42 which is supported on the flange 24 with resilient deformation by the weight of the drawer plus the drawer contents. In the fully closed position represented, a concave indentation 44 extending a short distance in the drawer opening direction is formed in alignment with the tire 42; it is somewhat deeper than the elevation of the tire 42 above the rolling surface 40, so that, as it is apparent, the tire 42 does not lie on the flange 24 in this end position. Instead, in this fully closed state of the drawer, the wheel 36 rests with its rolling surface 40 against the inside surface of the flange. This assures that the tire 42 will not be deformed by flattening when the drawer is completely closed and accordingly it cannot be permanently deformed, either.

It is evident that an indentation corresponding to indentation 44 can also be provided in the front-end part of the flange 32 of the runner track 18, in alignment with the resilient tire provided in the rolling surface of the wheel journaled in the forward end portion on the web 20 of the guide track 14, which accordingly is not deformed, either, when the drawer is in the fully closed state.

Modifications and further developments of the above-described embodiment can be made within the scope of the invention. Thus, the explained principle of relieving the resiliently deformable tire of stress when the tracks are in the closed state can also be applied to so-called half drawers, slides or platforms in order to permit a greater length of travel. It is important only that indentations be provided corresponding to the indentation 44 in the areas of the flange opposite the wheels when the drawer is fully closed. It may furthermore be desirable to provide such indentations in the flanges of the track also in those areas which are opposite the wheels of the other track when the drawer is in the fully extended position. Particularly when drawer guides are involved which are stressed in the open position for long periods of time—example in the case of filing cabinet drawers—may be desirable to provide for relieving the load on the tires also in the open state.

I claim:

1. A guide for a drawable cabinet part, comprising: an elongated guide rail for fastening to a cabinet carcase, and having a front end and a rear end, and a flange; an elongated runner rail for fastening to a drawable cabinet part, and having a front end and a rear end, and also having a flange; said rails being displaceable relative to one another on first roller means rotatably mounted on the front end of the guide rail and rolling on the flange of the runner rail, and on second roller means rotatably mounted on the rear end of the runner rail and rolling on the flange of the guide rail; at least one circumferential groove in each roller surface of the roller means, a resilient tire inserted respectively into said roller means and protruding slightly above the rolling surface, end sections of the track flanges supported on the rolling surfaces of the respective roller means in fully retracted position of the tracks having a narrow indentation in alignment with the respective resilient tire and extending a short distance in the opening direction of the drawer, the depth of the indentation being at least equal to the radial elevation of the resilient tire above the rolling surface of the respective roller means.

2. A guide according to claim 1, wherein a further narrow indentation extending a short distance in the drawer opening direction and having a depth at least equal to the radial elevation of the resilient tire above the rolling surface of the respective roller means is provided in alignment with the resilient tire in end sections of the flanges resting on the rolling surfaces of the roller means when the tracks are in fully extended position.

* * * * *